US006925820B2

(12) United States Patent
Erisgen

(10) Patent No.: US 6,925,820 B2
(45) Date of Patent: Aug. 9, 2005

(54) LOW PROFILE CONDENSING UNIT

(75) Inventor: Sukru Erisgen, Tecumseh, MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/794,111

(22) Filed: Mar. 5, 2004

(65) Prior Publication Data

US 2004/0168457 A1 Sep. 2, 2004

Related U.S. Application Data

(63) Continuation of application No. 10/306,362, filed on Nov. 27, 2002, now Pat. No. 6,751,973.

(60) Provisional application No. 60/373,165, filed on Apr. 17, 2002.

(51) Int. Cl.[7] ..... A47F 3/04

(52) U.S. Cl. ..... 62/115; 62/246; 62/295; 411/187

(58) Field of Search ..... 411/18–181, 187, 411/188; 62/246, 259.1, 295, 298, 302, 508

(56) References Cited

U.S. PATENT DOCUMENTS

| | | | | |
|---|---|---|---|---|
| 1,789,916 A | | 1/1931 | Thornton, Jr. | |
| 1,898,440 A | | 2/1933 | Greenwald | |
| 1,910,865 A | | 5/1933 | Tarleton | |
| 2,027,192 A | | 1/1936 | Muffly | 62/116 |
| 2,101,881 A | | 12/1937 | Terry et al. | 230/58 |
| 2,250,612 A | | 7/1941 | Tanner | 62/103 |
| 2,254,604 A | | 9/1941 | Forsthoefel | 62/116 |
| 2,285,945 A | | 6/1942 | Rundell | 62/102 |
| 2,713,777 A | | 7/1955 | Mansmann | 62/117 |
| 2,811,840 A | | 11/1957 | Thompson | 62/117.4 |
| 2,885,142 A | * | 5/1959 | Eberhart | 417/350 |
| 3,712,078 A | * | 1/1973 | Maynard et al. | 62/448 |
| 4,132,088 A | | 1/1979 | Grosskopf | 62/298 |
| 4,577,402 A | * | 3/1986 | Swanstrom | 29/840 |
| 5,184,474 A | | 2/1993 | Ferdows | 62/244 |
| 5,579,651 A | | 12/1996 | Sugiyama et al. | 62/469 |
| 5,622,058 A | | 4/1997 | Ramakrishnan et al. | 62/295 |
| 5,638,693 A | | 6/1997 | Baek | 62/262 |
| 5,848,536 A | | 12/1998 | Dodge et al. | 62/240 |
| 6,070,424 A | | 6/2000 | Bauman et al. | 62/279 |
| 6,125,524 A | * | 10/2000 | Mueller | 29/520 |
| 6,171,076 B1 | | 1/2001 | Gannaway | 417/350 |
| 6,276,157 B1 | | 8/2001 | Morales | 62/262 |
| 6,318,940 B1 | * | 11/2001 | Mitts | 411/188 |

* cited by examiner

*Primary Examiner*—William E. Tapolcai
(74) *Attorney, Agent, or Firm*—Baker & Daniels

(57) ABSTRACT

A condensing unit which includes a base plate having first and second oppositely disposed major surfaces. The base plate may include flanges disposed along the outer periphery of the base plate. A compressor mechanism and a condensing coil are mounted to the first major surface which faces a first direction. The flanges may also extend in the first direction. The second major surface may be substantially free of projections and define a bearing surface for the condensing unit. The motor of the compressor may have a main shaft which extends substantially parallel to the first major surface. The compressor may be a rotary compressor. There may be a conduit in fluid communication with the compressor and condensing coil and define together therewith a fluid circuit. Valves rotatably mounted on brackets and in fluid communication with the fluid circuit and operably couplable to an evaporator circuit may also be provided.

23 Claims, 6 Drawing Sheets

LOW PROFILE CONDENSING UNIT

CROSS REFERENCE TO RELATED APPLICATION

This application is a continuation of application Ser. No. 10/306,362 filed on Nov. 27, 2002, now U.S. Pat. No. 6,751,973, which claims priority under 35 U.S.C. 119(e) of U.S. provisional patent application Ser. No. 60/373,165 filed on Apr. 17, 2002 entitled LOW PROFILE CONDENSING UNIT. The disclosure of both U.S. patent application Ser. No. 10/306,362 and provisional patent application Ser. No. 60/373,165 are hereby incorporated herein by reference.

BACKGROUND OF THE INVENTION

1. Field of the Invention

The present invention relates to condensing units and, more specifically, condensing units which are adapted for mounting in a case or housing.

2. Description of the Related Art

Conventional refrigerated display cases are used in a variety of locations including retail locations such as supermarkets, gas stations and convenience stores. These cases are provided with refrigeration systems that are used to cool the cases and the items stored therein. Current display cases may include a large condensing unit which sits in a mechanical room or on the roof of a building. Large refrigeration lines may be used to carry refrigerant from a central condensing unit to multiple display cases within the store to refrigerate the cases and cool the items located therein.

A disadvantage of using a central condensing unit is that in the event of a refrigerant leak, the entire refrigeration charge supplying several fluidly linked refrigerated cases may leak into the atmosphere. Further, due to the fact that the cases are interconnected, a failure of the system may result in the loss of the refrigeration capability of all of the interconnected cases.

It is also known to use separate condensing units for individual refrigerated cases. The use of such separate condensing units limits the amount of refrigerant loss in the event of a leak and also limits the effect of such a failure to a single refrigerated case. The condensing units used with such refrigerated cases, however, are oftentimes large and bulky and may have a negative impact on the design and aesthetics of the refrigerated case in which the condensing unit is mounted.

FIG. 2 illustrates a prior art condensing unit 120 which is adapted for use with an individual refrigerated display case. Prior art unit 120 includes a vertically oriented compressor 122 coupled to a condenser coil 124. A single fan 126 is secured to condenser 124. Service valves 128 are mounted to base plate 130 and the upper portion of valves 128 are adapted to be rotated in 90 degree intervals with respect to base portion 132 of valves 128. Base plate 130 includes downwardly bent flanges 134 along each of its four outer edges. Downwardly extending flanges 134 form a skirt which encloses a space below base plate 130. Bolts securing compressor 122 and mounting brackets 132 have threaded shafts which extend through base plate 130 and project into the space enclosed by flanges 134. Nuts are threaded onto the bolt shafts to secure the condensing unit components to base plate 130 and are disposed in the space enclosed by flanges 134. It is also known to turn base plate 130 upside down for use with a condensing unit 120 wherein flanges 134 project upwardly.

SUMMARY OF THE INVENTION

The present invention provides a condensing unit having a compact design which facilitates its mounting in a housing or case and thereby provides enhanced flexibility in the design of the refrigerated case in which the unit is mounted.

The invention comprises, in one form thereof, a condensing unit including a base plate having a first upwardly facing major surface, an oppositely disposed second downwardly facing major surface and an outer periphery. The base plate has a configuration defining a central plane and includes at least one rigidifying portion extending at an angle to the central plane. A compressor having a substantially horizontal major axis and a condensing coil are each mounted to the first major surface. The compressor may be a rotary compressor and is operably coupled to the condensing coil. The second major surface defines a bearing surface substantially free of projections. The at least one rigidifying portion may include an upwardly extending flange disposed along the outer periphery of the base plate and the bearing surface may define a substantial portion of the downwardly facing second major surface.

The invention comprises, in another form thereof, a condensing unit including a base plate having a first major planar surface facing a first direction, an oppositely disposed second major planar surface and an outer periphery. The base plate includes at least one flange extending substantially transverse to said first and second major planar surfaces and disposed along a portion of the outer periphery. The at least one flange extends in the first direction. A compressor having a substantially horizontal major axis and a condensing coil are each mounted to the first major planar surface. The compressor, which may be a rotary compressor, is operably coupled to the condensing coil. The second major planar surface defines a bearing surface providing support for the condensing unit and is substantially free of flanges extending in a second direction opposite the first direction.

The invention comprises, in yet another form thereof, a refrigerated display case which includes a housing defining a refrigerated space. The housing further defines a condenser space having a length, a width and a height wherein the height is less than the length and the width. A condensing unit is mounted in the condenser space and includes a base plate having a first major surface facing upwardly, an oppositely disposed second major surface and an outer periphery. The base plate also includes at least one flange extending substantially transverse to the first and second major surfaces and disposed along a portion of the outer periphery with the at least one flange extending upwardly. A rotary compressor and a condensing coil are each mounted to the first major surface. The compressor includes a motor having a main shaft extending substantially parallel to the first major surface. The compressor is operably coupled to the condensing coil. The second major surface defines a bearing surface providing support for the condensing unit which is substantially free of projections.

In alternative embodiments, the condensing unit of the present invention may include a base plate which is substantially rectangular and defines four edges along its outer periphery wherein four flanges extend in the first direction and one of the flanges is disposed along each of the edges. The condensing coil may be disposed along one edge of the base plate with at least one fan disposed adjacent the condensing coil. The adjacently disposed fan may be a plurality of fans and each of such fans may be disposed in a cylindrical shroud.

The condensing unit may also include at least one valve and at least one mounting bracket wherein the mounting bracket has a first portion secured to the first major surface and a second portion extending outwardly from the first major surface and the at least one service valve is rotatably secured to the second portion at a position spaced from the first major surface. The compressor of the condensing unit may also be secured to the base plate with fasteners extending through the base plate wherein each of the fasteners has a head disposed substantially flush with the second major surface. The compressor may also include a motor having a main shaft wherein the main shaft extends substantially parallel to the first major surface and concentrically with the major axis of the compressor. Additionally, the condensing coil may be disposed within a coil housing having a horizontal length and a vertical height wherein the length is substantially greater than the height.

The invention comprises, in another form thereof, a condensing unit for coupling with an evaporator circuit wherein the condensing unit includes a base plate having a first major surface, an oppositely disposed second major surface and an outer periphery. A rotary compressor including a motor having a main shaft is mounted on the base plate wherein the main shaft extends substantially parallel to the first major surface. A condensing coil is also mounted on said base plate. At least one fluid conduit in fluid communication with the compressor and the condensing coil is provided wherein the at least one fluid conduit, compressor and condensing coil define a fluid circuit. At least one fan is disposed proximate the condensing coil and first and second valves are mounted on the base plate wherein the first and second valves are in fluid communication with the fluid circuit and operably couplable to the evaporator circuit.

The condensing unit may further include an electrical box mounted to the base plate wherein the electrical box, the compressor and the condensing coil all project in a first direction from the base plate, the first direction being substantially perpendicular to the first major surface, and wherein either the compressor or the condensing coil project a greater distance in the first direction than the electrical box. The first and second valves may be disposed proximate the outer periphery. First and second mounting brackets for mounting the first and second valves may also be included wherein each of the mounting brackets have a first portion secured to the first major surface and a second portion extending outwardly from the first major surface. The first and second valves are rotatably secured to the second portions of the first and second mounting brackets respectively at positions spaced from the first major surface.

The invention comprises, in still another form thereof, a condensing unit including a base plate having a first major surface, an oppositely disposed second major surface and an outer periphery. A rotary compressor including a motor having a main shaft is mounted on the base plate wherein the main shaft extends substantially parallel to the first major surface. A condensing coil is also mounted on the base plate. At least one fluid conduit in fluid communication with the compressor and the condensing coil is provided wherein the at least one fluid conduit, compressor and condensing coil define a fluid circuit. At least one fan is disposed proximate the condensing coil.

The condensing unit may further include an electrical box mounted to the base plate wherein the electrical box, the compressor and the condensing coil all project in a first direction from the base plate, the first direction being substantially perpendicular to the first major surface, and wherein either the compressor or the condensing coil project a greater distance in the first direction than the electrical box. The condensing coil may be at least partially disposed within a coil housing wherein the at least one fan is secured to the coil housing.

The invention comprises, in another form thereof, a refrigerated display case which includes a housing defining a refrigerated space. The housing further defines a condenser space having a length, a width and a height wherein the height is less than the length and the width. A condensing unit is mounted in the condenser space and includes a base plate having a first major surface, an oppositely disposed second major surface and an outer periphery. A rotary compressor including a motor having a main shaft is mounted on the base plate wherein the main shaft extends substantially parallel to the first major surface. A condensing coil is mounted within a coil housing disposed on the base plate. At least one fluid conduit in fluid communication with the compressor and the condensing coil is provided wherein the at least one fluid conduit, compressor and condensing coil define a fluid circuit. At least one fan is mounted to the coil housing and is positioned to draw air towards the fan across the coil and blow air away from the fan across the compressor.

The invention comprises, in another form thereof, a condensing unit including a base plate having a first major surface, an oppositely disposed second major surface and an outer periphery. A compressor including a motor having a main shaft is mounted on the base plate wherein the main shaft extends substantially parallel to the first major surface. A condensing coil is also mounted on the base plate. At least one fluid conduit in fluid communication with the compressor mechanism and the condensing coil is provided wherein the at least one fluid conduit, compressor and condensing coil define a fluid circuit. At least one valve and at least one mounting bracket are also provided wherein the valve is in fluid communication with the fluid circuit. The mounting bracket has a first portion secured to the first major surface and a second portion extending outwardly from the first major surface with the valve being mounted to the second portion.

The condensing unit may further include a second valve in fluid communication with the fluid circuit and a second mounting bracket wherein the second mounting bracket is secured to the first major surface and the second valve is mounted to the second mounting bracket at a position spaced from the first major surface. The valves may be rotatably mounted to the mounting brackets. The base plate may also have a configuration defining a central plane and include at least one rigidifying portion extending at an angle to the central plane and wherein the second major surface defines a bearing surface substantially free of projections.

An advantage of the present invention is that it provides a condensing unit having a compact design which thereby facilitates its mounting in a refrigerated case or air conditioner. Further, a condensing unit having such a compact design provides designers of refrigerated cases and air conditioners with greater flexibility in the functional and aesthetic design of such equipment.

Another advantage is that the condensing unit of the present invention facilitates the design of refrigerated cases which do not require any external piping to be connected to the refrigerated case and thereby provides such refrigerated cases with enhanced flexibility in the positioning and repositioning of the refrigerated cases in a retail environment.

Yet another advantage is that by providing a condensing unit having a compact design and a bearing surface which is substantially free of projections, the removal of the condensing unit from the housing in which it is mounted, as may be required for repair or maintenance, is facilitated.

BRIEF DESCRIPTION OF THE DRAWINGS

The above-mentioned and other features and objects of this invention, and the manner of attaining them, will become more apparent and the invention itself will be better understood by reference to the following description taken in conjunction with the accompanying drawings, wherein.

Although the exemplification set out herein illustrates an embodiment of the invention, in one form, the embodiment disclosed below is not intended to be exhaustive or to be construed as limiting the scope of the invention to the precise form disclosed.

DESCRIPTION OF THE PRESENT INVENTION

Figure 1:
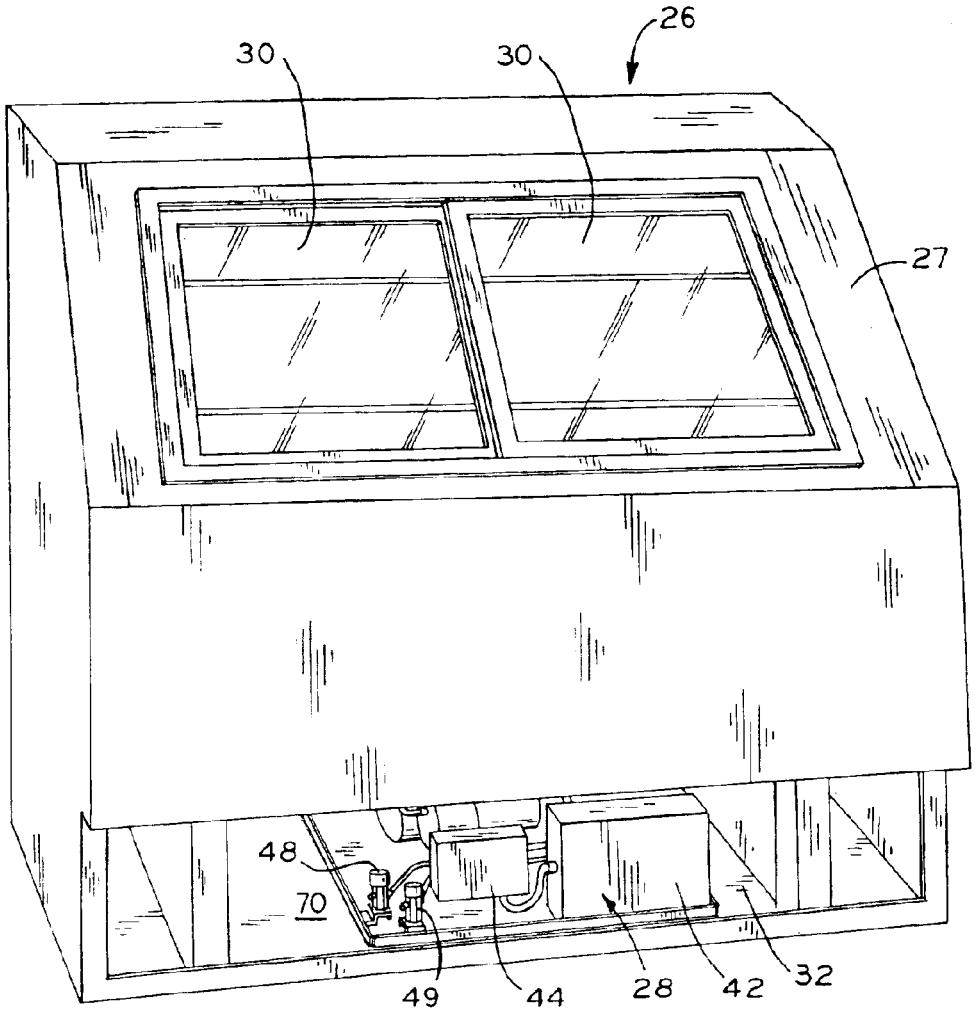
FIG. 1 is a perspective view of a refrigerated display case in accordance with the present invention.
Figure 2:
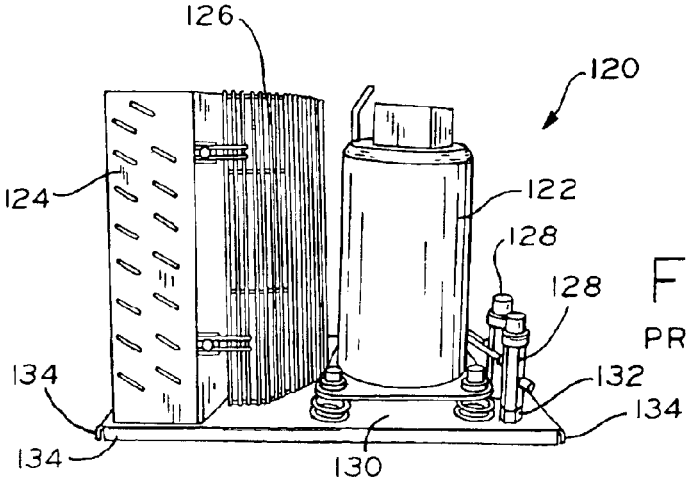
FIG 2 PRIOR ART
FIG. 2 is a perspective view of a prior art condensing unit.

Referring to FIG. 1, refrigerated display case 26 is provided with condensing unit 28 mounted in the lower portion thereof. Refrigerated display case 26 may be placed in retail establishments for storing and displaying refrigerated items for sale. Illustrated display case 26 is provided with sliding doors 30 which include a transparent panel to provide visual access to the contents of the refrigerated space defined within housing 27 of display case 26. Doors 30 are openable to allow customers to gain self-service access to the contents of case 26 such as beverages or perishable food items. Located in the lower portion of refrigerated display case 26 is compartment 32 in which condensing unit 28 is located. Compartment 32 has a length, width, and height with the height of compartment 32 being substantially less than the length and width. Except for condensing unit 28 and its combination with compartment 32, display case 26 has a conventional construction and is manufactured using conventional methods and materials.

In the illustrated embodiment, compartment 32 includes a bottom planar surface 70 on which condensing unit 28 is positioned. Alternative embodiments, however, could utilize a compartment 32 without a bottom panel member and support condensing unit 28 using support brackets such as L-shaped angle irons. Such support brackets could extend from the front to back of compartment 32 along the outer edges of base plate 36 and at intermediate locations below base plate 36. A grill (not shown) which permits the passage of air therethrough is removably mounted across the lower portion of case 26 to cover the opening to compartment 32. FIG. 1 illustrates case 26 with the grill removed to permit access to compartment 32. A grill, or similar feature which permits the passage of air therethrough, is located opposite opposite the opening to compartment 32 on the rear surface of case 26 to facilitate the passage of air through compartment 32.

Figure 3:
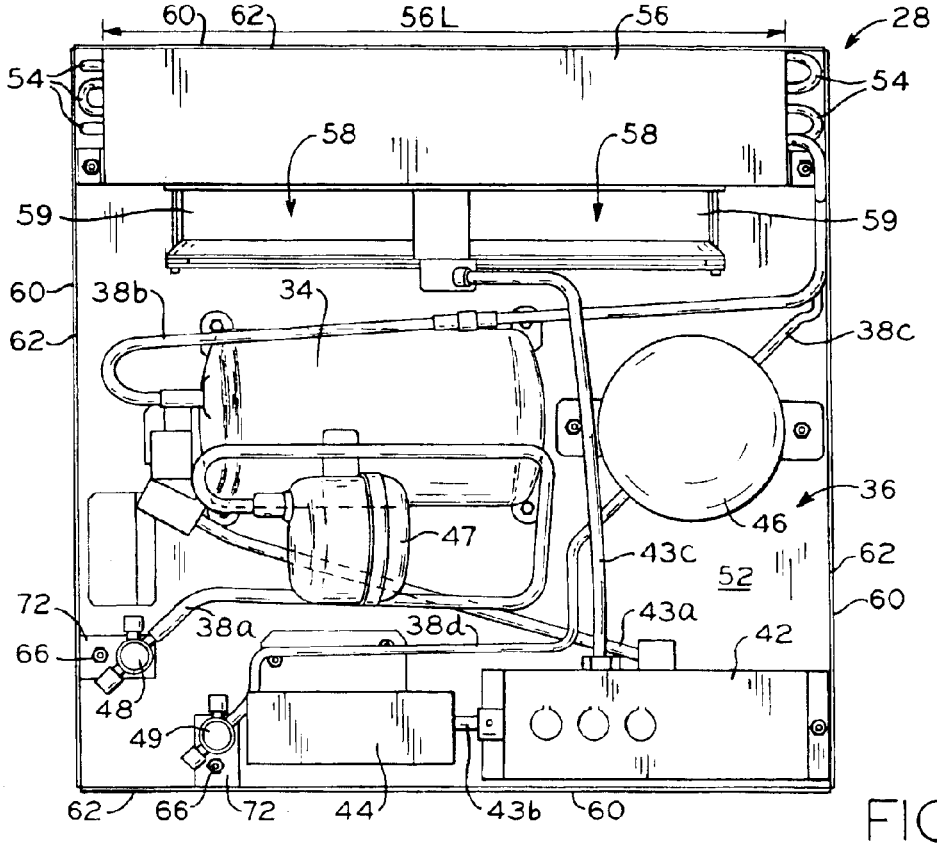
FIG. 3 is a top view of a low profile condensing unit in accordance with the present invention.

Referring to FIG. 3, condensing unit 28 includes compressor 34 mounted to base plate 36. Compressor 34 includes a compressor mechanism 31 and a motor 33 with a main shaft 35 for driving compressor mechanism 31. Main shaft 35 is oriented substantially horizontally and, thus, is oriented substantially parallel to upper surface 52 of base plate 36. FIG. 3 schematically illustrates compressor mechanism 31, motor 33 and main shaft 35. In horizontally oriented compressors such as compressor 34, the compressor assembly, including the main shaft extending between the compressor mechanism and the motor, although substantially horizontal, will often be slightly inclined relative to a horizontal plane to facilitate the operation of the compressor, e.g., by facilitating the collection of lubricating oil within the compressor at one end thereof.

Compressor 34 may be a HG model rotary compressor that is commercially available from Tecumseh Products Company located in Tecumseh, Mich. For larger capacity applications, HK model rotary compressors also commercially available from Tecumseh Products Company may be used. A horizontally oriented twin rotary compressor may also be used with condensing unit 28. U.S. Pat. No. 6,171,076 B1 assigned to assignee of the present invention discloses one such horizontally oriented twin rotary compressor and is expressly incorporated herein by reference. Other compressors having a relatively low profile may also be used with condensing unit 28. For example, a horizontally oriented scroll compressor could also be used with condensing unit 28.

Fluid conduits 38*a*–38*d* provide fluid communication between the various components of condensing unit 28 and together with those components define the condensing unit fluid circuit 28F. First service valve 48 is a suction valve and is in fluid communication with accumulator 47 of compressor 34 through conduit 38*a*. Compressor 34 is in fluid communication with condensor coil 54 through conduit 38*b*. Conduit 38*c* provides fluid communication between condensor coil 54 and receiver 46. Conduit 38*d* provides fluid communication between receiver 46 and second service valve 49 which is the discharge valve.

Figure 10:
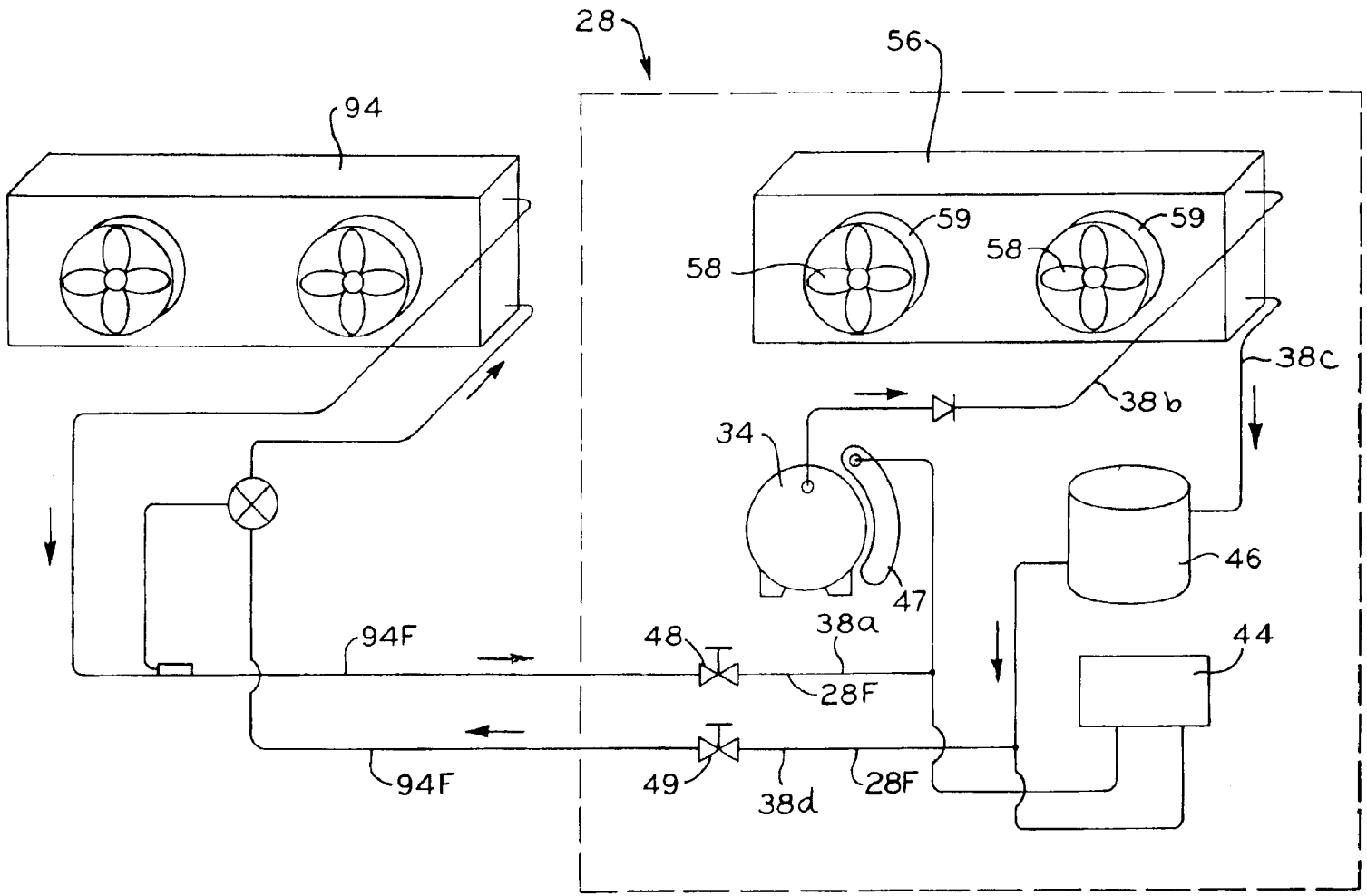
FIG. 10 is a schematic view of a low profile condensing unit in accordance with the present invention.

Also mounted to base plate 36 are electrical box 42 and pressure switch 44. As best shown in FIG. 10, pressure switch 44 is in fluid communication with condensing unit fluid circuit 28F at a first location between suction valve 48 and accumulator 47 and at a second location between receiver 46 and discharge valve 49. Electrical conduits 43*a*, 43*b* and 43*c* extend outwardly from electrical box 42 to compressor 34, pressure switch 44 and fans 58 respectively for conveying electrical power and control lines.

Figure 4:
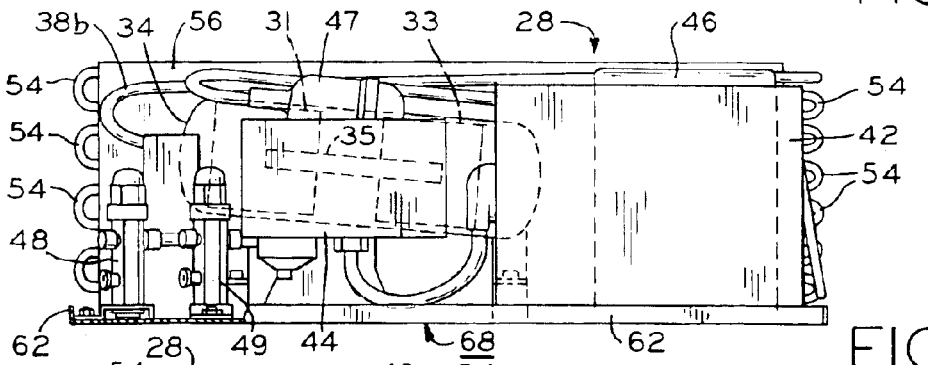
FIG. 4 is a front view of the low profile condensing unit of FIG. 3.
Figure 5:
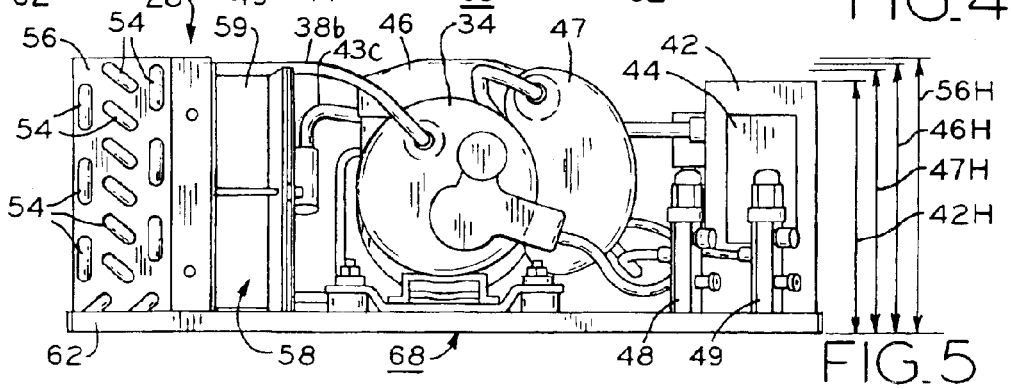
FIG. 5 is a side view of the low profile condensing unit of FIG. 3.

As best seen in FIGS. 4 and 5, the use of a horizontally oriented compressor 34 allows condensing unit 28 to have a relatively low profile or height. The remainder of the condenser unit components are sized so as not to significantly exceed the height of compressor 34 and thereby provide a compact design for condensing unit 28. This also allows for compartment 32 in refrigerated display case 26 to have a compact design thereby facilitating flexibility in the design of display case 26 and potentially smaller and sleeker designs of such refrigerated cases.

In the illustrated embodiment and as can be seen in FIG. 4, base plate 36 includes first and second oppositely disposed major planar surfaces 52 and 68. First major surface 52 faces in a first direction perpendicular to major surface 52, which in the illustrated embodiment is upwardly, and flanges 62, which are substantially transverse to first and second major surfaces 52, 68, extend upwardly in the first direction. Similarly, all of the condensing unit components are mounted to the first major surface and project upwardly in the first direction. Coil housing 56 for condensing coil 54 projects the greatest distance above upper surface 52 of base plate 36 in the first direction as shown by dimension line 56H. Similarly, and as can be seen in FIG. 4, receiver 46 projects a distance 46H, accumulator 47 which is secured to the housing of compressor 34 projects a distance 47H and electrical box 42 projects a distance 42H above upper surface 52 of base plate 36. In the illustrated embodiment, height 56H of housing 56 is approximately seven inches, i.e., 7.224 inches and the maximum height of compressor 34 which corresponds to distance 47H is 6.836 inches. In the illustrated embodiments, distance 46H falls between distances 54H and 47H and distance 42H is less than distances 54H, 46H and 47H.

Condensing coil 54 and coil housing 56 are configured to provide condensing unit with a low profile. As can be seen in the Figures, coil housing 56 has a horizontal length 56L which is substantially greater than the vertical height 56H of housing 56. Coil 54 and housing 56 are located along an edge of base plate 36 to allow coil 54 and housing 56 to be positioned near a grill or other openings in housing 27. Fans 58 draw air from outside case 26 through the grill or openings in housing 27 and through coil housing 56 across coil 54 to cool coil 54 and the compressed refrigerant therein. After passing across coil 54, fans 58 blow the air towards the opening of compartment 32 shown in FIG. 1 where it exits housing 27 through a removable grill (not shown) which covers the opening to compartment 32.

Figure 6:
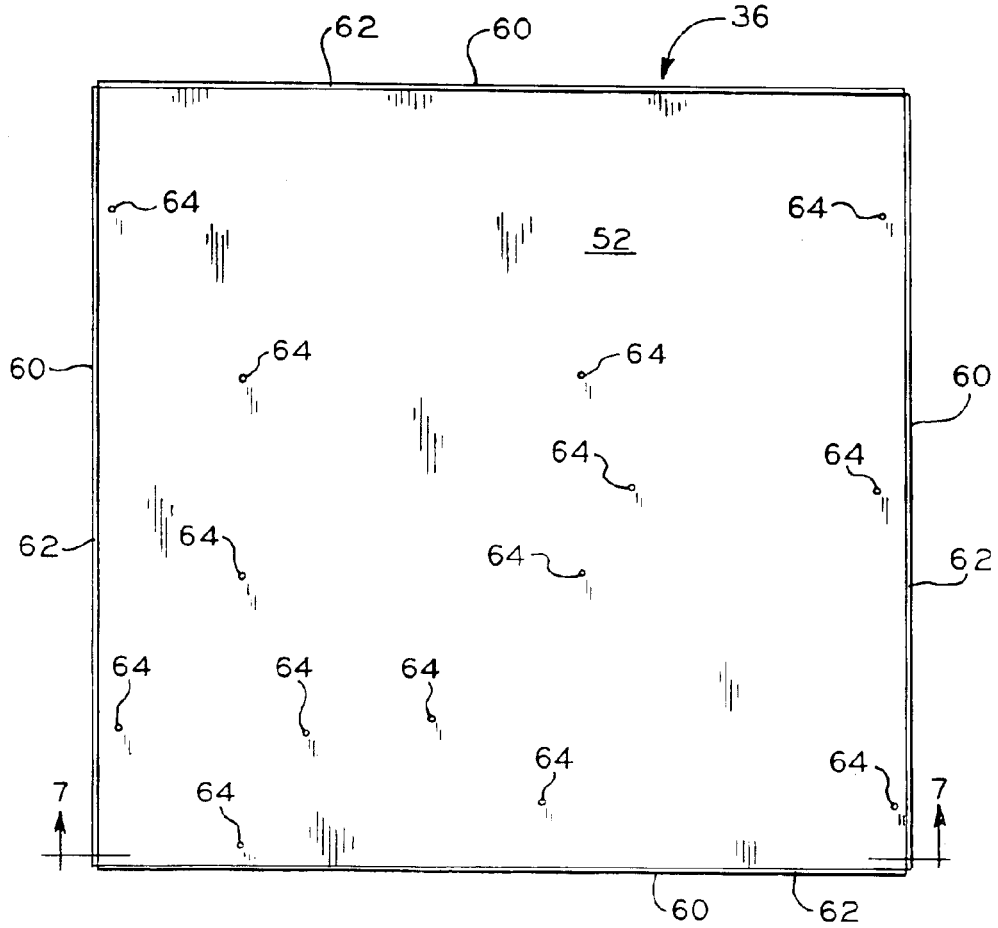
FIG. 6 is a top view of a base plate used with the low profile condensing unit of FIG. 3.
Figure 7:
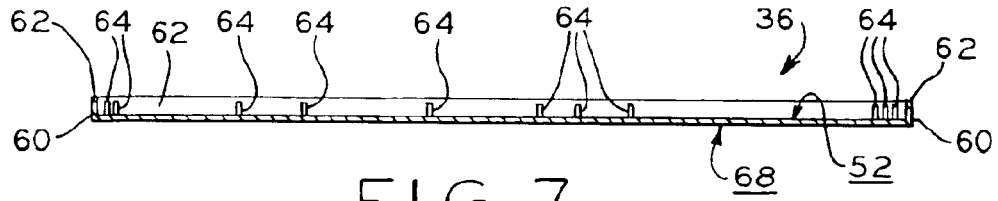
FIG. 7 is a sectional view of the base plate of FIG. 6 taken along line 7—7.

Base plate 36 is illustrated in FIGS. 6 and 7 and has an outer periphery 60 which, in the illustrated embodiment, is defined by four sides and substantially rectangular. Illustrated base plate 36 is approximately 20 inches by 20 inches. Other shapes and sizes of base plate 36 may also be used with the present invention. Each edge or side of illustrated base plate 36 is provided with an upwardly extending flange 62. Flanges 62 form rigidifying portions which provide base plate 36 with structural rigidity. By employing flanges 62 which extend upwardly rather than downwardly, the vertical distance that would be occupied by the use of downwardly extending flanges can be eliminated, thereby facilitating a reduction in the overall height of condensing unit 28.

Base plate 36 is provided with a plurality of apertures through which the threaded shafts of self-clinching fasteners 64 pass. Self-clinching fasteners 64 together with nuts 66 are used to mount the components of condensing unit 28 to base plate 36 either directly or indirectly such as via mounting brackets.

Fasteners 64 have a head located at one end and when secured to base plate 36, the head is substantially flush with lower surface 68 of base plate 36 projecting only a minimal distance outwardly therefrom. By using fasteners 64 which are substantially flush with lower surface 68, lower surface 68 is substantially free of projections to facilitate the use of lower surface 68 as a bearing surface for supporting the weight of condensing unit 28 and allowing surface 68 to be in direct contact with substantially planar mounting surface 70 (FIG. 1) of refrigerated display case 26 or other device employing the low profile condensing unit 28 of the present invention.

Figure 12:
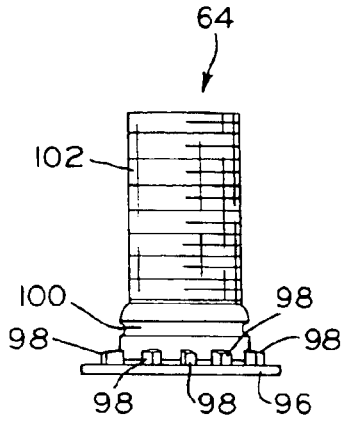
FIG. 12 is a side view of a self-clinching fastener.

Fasteners 64 may be flush-head studs available from PEM Fastening Systems, a PennEngineering Company having a place of business at 5190 Old Easton Road, Danboro, Pa. 18916. In the illustrated embodiment, fasteners 64 are ½ inch long self-clinching studs having ¼ inch-20 threads sold under part number FH-0420-20-Z1 by PEM Fastening systems except for those fasteners 64 which are used to secure compressor 34 which are 1.842 inch long self-clinching studs with ¼ inch-20 threads. As shown in FIG. 12, such fasteners have a mounting portion including a relatively thin head 96 with circumferentially spaced ribs 98 on the underside of the head positioned adjacent an annular groove 100 in shaft 102 proximate head 96. As fastener 64 is secured to base plate 36, head 96 is squeezed into the sheet material forming base plate 36 and the sheet material displaced by head 96 flows around ribs 98 and into annular groove 100 to secure fasteners 64 to the sheet material forming base plate 36.

Alternative fasteners which do not project substantially beyond lower surface 68 of base plate 36 may also be used with base plate 36 to secure the condensing unit components to base plate 36. The condensing unit components or mounting brackets therefor may also be secured to base plate 36 by welding or adhesives and still maintain lower surface 68 substantially free of projections. It is advantageous to use such fasteners which do not project substantially beyond lower surface 68 of base plate 36 to enable base plate 36 to be placed on a flat surface within the refrigerated case and have lower surface 68 thereby act as a bearing surface. If the fasteners project to a large extent, such as by the thickness of a conventional bolt head, and base plate 36 were placed on a substantially flat planar surface, base plate 36 would likely deform base plate 36 sufficiently that surfaces 52 and 68 of base plate 36 would no longer be substantially planar. Relatively large projections extending beyond lower surface 68 would also negatively impact the ability to slide base plate 36 into position in the cabinet In alternative embodiments, the base plate could employ rigidifying portions which differed in shape or configuration from upwardly extending flanges 62 wherein the downwardly facing surface of the base plate still provide a bearing surface substantially free of projections. Such a bearing surface might not comprise the entirety of the downwardly facing base plate surface yet still form a substantial portion of such downwardly facing surface and define a bearing surface which provides sufficient support for the condensing unit to avoid gross deformation of the base plate. For example, upwardly projecting ridges or ribs could be formed in the base plate to form rigidifying portions and still allow the downwardly facing surface of the base plate to define a bearing surface substantially free of projections.

Figure 8:
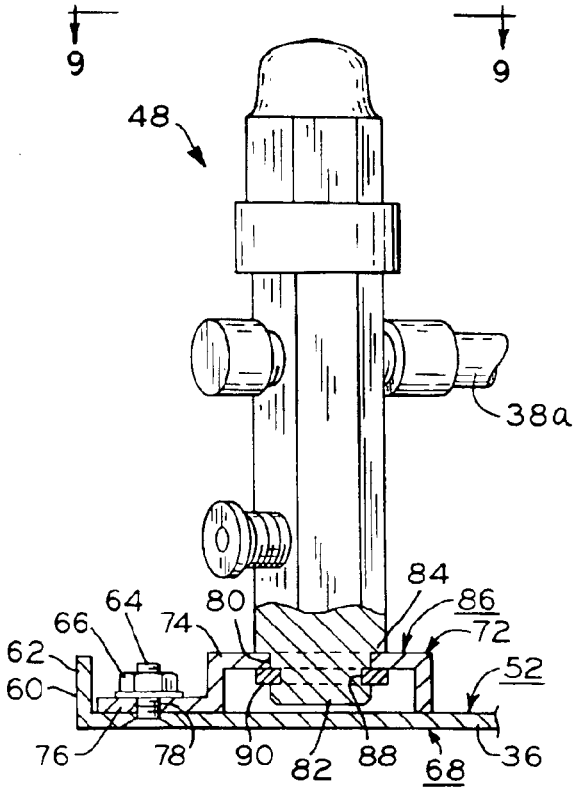
FIG. 8 is a partial sectional view of a service valve mounted to the base plate of the low profile condensing unit of the present invention.
Figure 9:
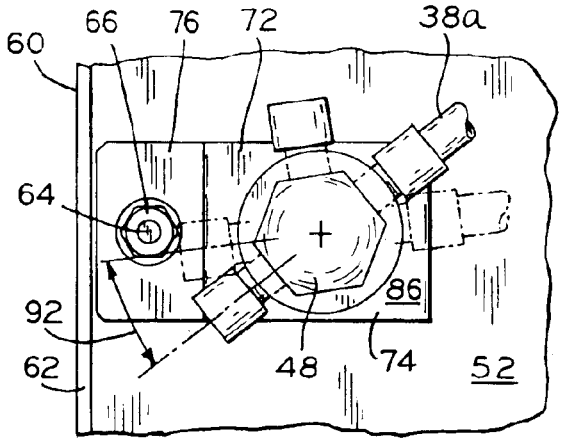
FIG. 9 is a top view of the service valve of FIG. 8 taken along line 9—9.

Referring to FIGS. 8 and 9, service valves 48, 49 are mounted to base plate 36 using brackets 72 that provide orientation flexibility to valves 48, 49. Brackets 72 are provided with first or base portions 76 which are secured to first major surface 52 and a second mounting portion 74 extending outwardly from surface 52 with valves 48, 49 being secured to mounting portions 74 at positions spaced from surface 52. Base portions 76 are provided with apertures 78 through which fasteners 64 extend with nuts 66 being threaded onto the threaded shafts thereof to secure brackets 72 to base plate 36. Mounting portions 74 are raised above base portions 76 and are provided with apertures 80 through which extension portions 82 of valves 48, 49 project. Shoulder portions 84 of valves 48, 49 rest upon surfaces 86 of mounting portions 74 to support valves 48, 49 thereon. Valves 48, 49 may be rotatably secured to brackets 72 using any suitable method including providing an annular groove 88 in extension portion 82 which receives a C-shaped retaining clamp 90. Referring to FIG. 9, valves 48, 49 are mounted to brackets 72 so that valves 48, 49 may rotate relative to brackets 72 as illustrated by arrow 92. Apart from being mounted to brackets 72, valves 48, 49 have a conventional construction. The bodies of valves 48, 49 are rotatable about the stem secured to brackets 72 and may be adapted to rotate in intervals of 45 or 90 degrees. The ability to rotate valves 48, 49 and thereby provide for the variable orientation of valves 48, 49 facilitates the connection of valves 48, 49 to evaporator fluid circuit 94F. Positioning valves 48, 49 proximate the outer periphery of base plate 36 also facilitates the attachment and detachment of valves 48, 49 from evaporator fluid circuit 94F such as during installation of condensing unit 28 or removal of condensing unit 28 as might be required for maintenance purposes.

FIG. 10 provides a schematic illustration of condensing unit 28 operably coupled with an evaporator 94. As shown, valves 48, 49 are coupled to evaporator fluid circuit 94F to provide fluid communication between fluid circuit 28F of condensing unit 28 and evaporator fluid circuit 94F. Condensing unit 28 and evaporator 94 operate in a conventional manner to cool the interior of refrigerated case 26. As shown in FIG. 10, refrigerant enters condensing unit 28 through suction valve 48 passes through conduit 38*a* and enters accumulator 47. The refrigerant is compressed after entering compressor 34 from accumulator 47. The compressed and heated refrigerant is discharged from compressor 34 and passes through conduit 38*b* to enter condenser coil 54. As refrigerant passes through coil 54, air flow generated by fans 58 cool the referigerant. Refrigerant exits coil 54 into conduit 38*c* which conveys the refrigerant to receiver 46. The refrigerant subsequently discharged from condensing unit 28 via conduit 38*d* and discharge valve 49. After entering evaporator fluid circuit 94F after being discharged through valve 49, the refrigerant passes through evaporator 94 and is returned to condensing unit 28 through suction valve 48.

Figure 11:
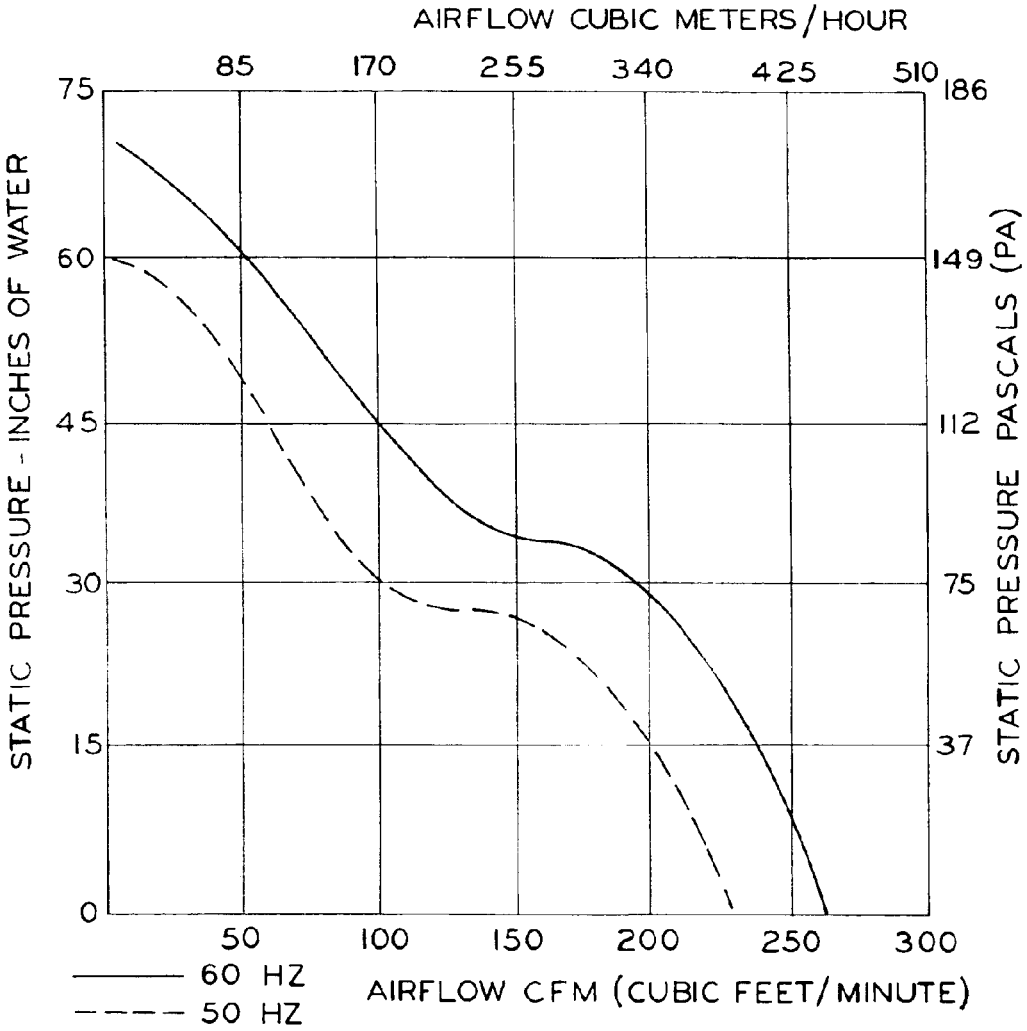
FIG. 11 is a graph illustrating performance characteristics of the low profile condensing unit.

Due to the low height and extended length of coil 54 and housing 56, two fans 58 are used with condensing coil 54 instead of a single fan to provide the necessary air flow to cool coil 54 and the refrigerant passing therethrough. In the disclosed embodiment fans 58 are permanent-split-capacitor tube-axial type fans (part no. W2E143-AA15-01) available from EBM Industries Inc. which has a place of business at 100 Hyde Road, Farmington, Conn. 06034. Fans 58 have fan blades which are enclosed in a generally cylindrical shroud 59, i.e., fans 58 are tube axial fans, to enhance their effectiveness. Fans 58 generate a cooling air flow for condensing coil 54 as well as for the rest of condensing unit 28. It is desirable for the fans of condenser unit 28 to be capable of running at −10% of the maximum rated speed of the fans when there is a 0.3 inches water pressure drop across the condensing coil. Due to the compact size of condensing unit 28, high efficiency fans having a blade diameter of approximately 6 inches may be advantageously employed to obtain the desired fan performance. Permanent-split-capacitor fans can be used to provide such a high efficiency fan. FIG. 11 provides a graph of a fan motor curve for illustrated condenser unit 28 which employs a pair of tube axial permanent-split-capacitor fans 58. The graph illustrates a first fan curve, i.e., the solid line, for a fan having a frequency of 60 Hz and a second curve, i.e., the dashed line, for a fan having a frequency of 50 Hz. In alternative embodiments, three lower efficiency fans having a blade diameter of approximately six inches, such as those obtainable from Morrill Motors, Inc. a company having a place of business in Erwin, Tenn. (P.O. Box 531, Erwin, Tenn., 37650-0531), may be positioned in cylindrical shrouds and substituted for the two high efficiency fans 58. A substantially cylindrical, cross flow blower fan having an appropriate shroud and appropriately sized motor may also be suitable to provide the desired operating characteristics.

While this invention has been described as having an exemplary design, the present invention may be further modified within the spirit and scope of this disclosure. This application is therefore intended to cover any variations, uses, or adaptations of the invention using its general principles.

What is claimed is:

1. A condensing unit comprising:

a base having a downwardly facing major surface and at least one aperture;

at least one condensing unit component, wherein said at least one condensing unit component is one or more of the following:

a condensing coil, a compressor having a substantially horizontal major axis, an electrical box, a receiver, an accumulator, a pressure switch, and a valve; and at least one fastener rigidly fixed to said base, said at least one fastener having a mounting portion, said mounting portion pressed into said base and permanently deforming said base proximal to said at least one aperture, said at least one fastener including a head portion, said mounting portion including said head portion, said head portion substantially flush with said downwardly facing major surface, said at least one condensing unit component fastened directly or indirectly to said base by said at least one fastener, wherein said major surface defines a bearing surface substantially free of projections.

2. The condensing unit of claim 1, said at least one fastener including.

3. The condensing unit of claim 1, said base further including at least one recess in said downwardly facing major surface, said at least one recess substantially surrounding said at least one aperture, said head portion positioned within said at least one recess.

4. The condensing unit of claim 1, said at least one fastener including a shaft portion, said shaft portion extending through said at least one base aperture, said head portion including a plurality of projections, said projections permanently deforming said base when said mounting portion is pressed into said base, said projections positioned circumferentially around said shaft portion, said head portion including recesses positioned intermediate said projections, wherein displaced material of said base flows into said recesses when said projections are pressed into said base, whereby said at least one fastener is retained in said at least one aperture.

5. The condensing unit of claim 1, said at least one fastener including a shaft portion, said shaft portion extending through said at least one base aperture, said shaft portion including a substantially annular groove proximal to said head portion, said head portion including a plurality of projections, said projections permanently deforming said base when said mounting portion is pressed into said base, wherein displaced material of said base flows into said annular groove when said projections are pressed into said base, whereby said at least one fastener is retained in said at least one aperture.

6. The condensing unit of claim 1, said at least one condensing unit component including a bracket, said bracket having at least one bracket aperture, said at least one fastener including a shaft portion, said shaft portion having a thread, said shaft portion extending through said at least one base aperture and said at least one bracket aperture; and a nut, said nut threadingly engaged with said shaft portion, said bracket positioned intermediate said nut and said base.

7. The condensing unit of claim 1, said base having a configuration defining a central plane, said base including at least one rigidifying portion extending at an angle to said central plane.

8. The condensing unit of claim 1, said base having an outer periphery, wherein a portion of said outer periphery is bent upward rigidifying said base.

9. The condensing unit of claim 1, wherein said base is substantially free of flanges extending in the direction of said downwardly facing major surface.

10. The condensing unit of claim 1, further including:

a mounting bracket, said mounting bracket having a first portion and a second portion, said first portion mounted to said base; and at least one valve, said at least one valve rotatably secured to said second portion, wherein said at least one valve may be rotated with respect to said second portion to make said at least one valve easily accessible.

11. A refrigerated display case comprising:

a housing defining a refrigerated space, said housing further defining a condenser space having a length, a width and a height, said height being less than said length and said width;

a condensing unit mounted in said condenser space, said condensing unit including a base plate having a first major surface facing upwardly, an oppositely disposed second major surface and an outer periphery, said base plate including at least one flange extending substantially transverse to said first and second major surfaces and disposed along a portion of said outer periphery, said at least one flange extending upwardly, said base plate having at least one base plate aperture, said condensing unit further including at least one condensing unit component, wherein said at least one condensing unit component is one or more of the following:

a condensing coil, a compressor having a substantially horizontal major axis, an electrical box, a receiver, an accumulator, a pressure switch, and a valve; and said condensing unit further including at least one fastener rigidly fixed to said base plate, said at least one fastener having a mounting portion, said mounting portion pressed into said base plate and permanently deforming said base plate proximal to said at least one aperture, said at least one fastener including a head portion, said head portion substantially flush with said second major surface, said at least one condensing unit component fastened directly or indirectly to said base plate by said at least one fastener, wherein said second major surface defines a bearing surface providing support for said condensing unit which is substantially free of projections.

12. The condensing unit of claim 11, said at least one fastener including a shaft portion.

13. The condensing unit of claim 11, said base further including at least one recess in said second major surface, said at least one recess substantially surrounding said at least one aperture, said head portion positioned within said at least one recess.

14. The condensing unit of claim 11, said at least one fastener including a shaft portion, said shaft portion extending through said at least one base plate aperture, said mounting portion including said head portion, said head portion including a plurality of projections, said projections permanently deforming said base plate when said mounting portion is pressed into said base plate, said projections positioned circumferentially around said shaft portion, said head portion including recesses positioned intermediate said projections, wherein displaced material of said base plate flows into said recesses when said projections are pressed into said base plate, whereby said at least one fastener is retained in said at least one aperture.

15. The condensing unit of claim 11, said at least one fastener including a shaft portion, said shaft portion extending through said at least one base plate aperture, said shaft portion including a substantially annular groove proximal to said head portion, said head portion including a plurality of projections, said projections permanently deforming said base plate when said mounting portion is pressed into said base plate, wherein displaced material of said base plate flows into said annular groove when said projections are pressed into said base plate, whereby said at least one fastener is retained in said at least one aperture.

16. The condensing unit of claim 11, said at least one condensing unit component including a bracket, said bracket having at least one bracket aperture, said at least one fastener including a shaft portion, said shaft portion having a thread, said shaft portion extending through said at least one base aperture and said at least one bracket aperture; and a nut, said nut threadingly engaged with said shaft portion, said bracket positioned intermediate said nut and said base plate.

17. The condensing unit of claim 11, said at least one flange comprising a portion of said outer periphery of said base plate that is bent upward, said base being substantially free of flanges extending in the direction of said second major surface.

18. The condensing unit of claim 11, further including:

a mounting bracket, said mounting bracket having a first portion and a second portion, said first portion mounted to said base; and at least one valve, said at least one valve rotatably secured to said second portion, wherein said at least one valve may be rotated with respect to said second portion to make said at least one valve easily accessible.

19. A method of assembling a condensing unit, said condensing unit including at least one condensing unit component, wherein said at least one condensing unit component is one or more of the following:

a condensing coil, a compressor having a substantially horizontal major axis, an electrical box, a receiver, an accumulator, a pressure switch, and a valve, said method comprising the steps of:

providing a base having a bottom surface and at least one base aperture;

pressing a head portion of a fastener into said base against said bottom surface, said head portion permanently deforming said base proximal to said at least one aperture during said pressing step, said head portion being substantially flush with said bottom surface, said fastener rigidly fixed to said base after said pressing step;

mounting said at least one condensing unit component to said base with said fastener.

20. The method of claim 19, said at least one condensing unit component having a bracket, said bracket having at least one bracket aperture, said method further comprising the steps of:

inserting a shaft portion of said fastener through said at least one base aperture prior to said pressing step;

inserting said shaft portion of said fastener through said at least one bracket aperture, said shaft portion having a thread; and threading a nut onto said shaft portion, said bracket positioned intermediate said nut and said base.

21. The method of claim 19, said base further including a top surface and a periphery, said method further including the steps of:

bending at least a portion of said base periphery upward toward said top surface; and supporting said condensing unit by said bottom surface.

22. The method of claim 19, said base having a top surface and a periphery, said method further including the steps of:

mounting a flange to said base for rigidifying said base, said flange not extending below said substantially planar bottom surface; and supporting said condensing unit by said bottom surface.

23. The method of claim 19, further including the steps of:

providing at least one valve and at least one mounting bracket, said at least one mounting bracket having a first portion and a second portion, said at least one valve rotatably secured to said second portion;

mounting said first portion to said base; and rotating said at least one valve with respect to said second portion to make said at least one valve easily accessible.

* * * * *

UNITED STATES PATENT AND TRADEMARK OFFICE

CERTIFICATE OF CORRECTION

PATENT NO. : 6,925,820 B2
DATED : August 9, 2005
INVENTOR(S) : Sukru Erisgen

It is certified that error appears in the above-identified patent and that said Letters Patent is hereby corrected as shown below:

Column 10,
Line 58, after "including" insert -- a shaft portion --.

Signed and Sealed this

First Day of November, 2005

JON W. DUDAS
*Director of the United States Patent and Trademark Office*